United States Patent [19]

Rhodes

[11] 4,338,848

[45] Jul. 13, 1982

[54] PIANO ACTION

[75] Inventor: Harold B. Rhodes, La Habra, Calif.

[73] Assignee: CBS Inc., New York, N.Y.

[21] Appl. No.: 161,658

[22] Filed: Jun. 23, 1980

[51] Int. Cl.[3] ..... G10C 3/18

[52] U.S. Cl. ..... 84/253; 84/1.1; 84/1.04; 84/433

[58] Field of Search ..... 84/1.1, 237, 404, 236, 84/238, 239, 243, 253, 433, 1.26, 1.04

[56] References Cited

U.S. PATENT DOCUMENTS

| | | | |
|---|---|---|---|
| 2,214,112 | 9/1940 | Schulze | 84/239 |
| 2,456,321 | 12/1948 | Rhodes | 84/404 |
| 2,469,667 | 5/1949 | Rhodes | 84/404 |
| 2,495,427 | 1/1950 | Shill | 84/238 |
| 3,270,608 | 9/1966 | Rhodes | 84/237 |
| 4,067,253 | 1/1978 | Wheelwright et al. | 84/1.26 X |

*Primary Examiner*—Richard A. Wintercorn
*Assistant Examiner*—Benjamin R. Fuller
*Attorney, Agent, or Firm*—Gausewitz, Carr, Rothenberg & Edwards

[57] ABSTRACT

An action is described for musical instruments of the piano type. Means are included for braking and restraining each hammer of the action to prevent bouncing, rebounding, or other undesired movement, when the key is depressed and the hammer is positioned at the escapement distance from the tone generating tine and also when the key is released and the hammer is at rest position. The braking and restraining means move arcuately in cooperation with the key to exert a wedging force against a portion of the head of the hammer to brake and restrain it in the desired positions.

10 Claims, 4 Drawing Figures

PIANO ACTION

BACKGROUND OF THE INVENTION

This invention relates to actions for musical instruments of the piano type. In particular, it relates to such actions wherein a hammer is activated and given rotational or pivotal momentum by the striking of a key such that the hammer strikes a tone generating means and then recoils or falls toward a rest position.

Numerous types of piano actions involving rotating or pivoting hammers and keys are well known in the art. Such actions are described, for example, in my U.S. Pat. Nos. 2,456,321 and 2,469,667.

One of the problems that has long plagued users of musical instruments of the piano type has been the problem of bouncing or rebounding hammers. I have addressed myself to this problem for more than thirty years and have made substantial improvements in piano actions to alleviate the problem (for example, as shown in my U.S. Pat. No. 3,270,608). However, with modern, highly sensitive sound generating and amplifying equipment, as used in quality electric pianos, the standards of performance have increased to the point where still additional improvements are desirable in order to produce highest quality pianos.

In a typical electric piano action, when the pianist strikes a key, the rear end of the key engages and thrusts a hammer so that the head of the hammer strikes the tine of a tone generating device, and the vibration of the tine is amplified and converted to audible sound. It is fundamental that the hammer must be in free rotational flight (that is, under no substantial pressure from the key) at the moment the hammerhead strikes the tine. This free rotational flight is essential, among other things, to prevent damping of the vibrations of the tine. Thus, it is essential that the upward motion of the rear of the key must terminate at a point sufficiently low that when it is engaged with the hammer at this point the head of the hammer is spaced slightly apart from the tine. In other words, when the key is fully depressed, it does not hold the hammerhead against the tine.

In practice, it has been found essential to design the piano action such that when the key is fully depressed, there is a substantial distance between the tine and the head of the hammer (after the hammer strikes the tine and recoils back into a stable position against the depressed key). This distance between the tine and the hammerhead is known as the escapement distance. Theoretically, the escapement distance need be no greater than the maximum deflection of the tine during its most extreme vibrations (i.e., a sufficient distance to keep the vibrating tine from being dampened by contact with the hammer). However, in practice it has been found that due to resilience in the action mechanisms, among other things, there is a tendency for the hammer to bounce or rebound from the escapement position upwardly to a position within range of the vibrating tine. This results in double-striking of the tine to superimpose consecutive tone generations on the system, and these are then amplified to create a distorted or imperfect musical product. Furthermore, since pianists can detect the movements and double-striking in their fingertips, it is distracting and disrupts their performance.

One solution to the bouncing, rebounding or double-striking problem is to design actions with large escapement distances sufficient to minimize the occasions when the hammer will bounce sufficiently to actually strike the tine twice on the same strike of the key. However, this does not prevent the distracting effect of the bounce on the pianist, and, furthermore, it interferes with certain styles of musical performance. For example, since the pianist can only exert control and power to the hammer during the pivoting motion of the key, it is highly desirable to continue the pivoting motion to the greatest possible extent (i.e., to design actions with the minimum feasible escapement distances). This is especially desirable for "soft" playing where the pianist does not enjoy the luxury of being able to strike the key heavily to impart substantial momentum to the hammer to carry it through the escapement distance to the tine.

The action described in my U.S. Pat. No. 3,270,608 completely eliminated double-striking of the tines under most circumstances by incorporating a braking surface on the key which cooperated with a portion of the foot of the hammer to substantially lock the hammer at the escapement distance from the tine when the hammer was fully depressed. However, under certain circumstances, it has been found that the problem of double-striking continues to plague pianists. The problem becomes particularly acute where sensitive actions are used with escapement distances of about $\frac{1}{8}''$ or less.

Another problem presented by actions in which there is even slight wiggling, bouncing, vibrating, or other irregular movements of the key or hammer occurs when auxiliary tone generators or synthesizers are used to give certain musical effects in addition to those generated by the vibrating tines. For example, to generate tones which are responsive in volume or pitch to the velocity of movement of the keys (rather than simply to the vibration of the tines), detecting devices to sense the movement of the keys must be used. Thus, for highest quality actions it is important to eliminate even slight movements of the keys which are not intended by the pianist. This means that the pianist must have the key movement totally under control throughout the pivoting action whether the key is being depressed or released, and the hammer is being impelled upwardly toward the tine or returning to rest position. There has thus been a need to provide a unitary means for controlling the key and hammer movements throughout their upward and downward cycles and especially when the key is at or near either its rest position or its fully depressed position with the hammer at its escapement position.

It has now been found that these and other objects can be achieved, and the problems of the prior art can be greatly alleviated or even eliminated, in accordance with the present invention.

SUMMARY OF THE INVENTION

This invention contemplates a method and means for controlling rebounding or other undesired movement of the key and hammer in musical instruments of the piano type by wedging a braking means against the hammer when the hammer has recoiled from striking the tine of the tone generator substantially to the escapement distance from the tine. The braking means is adapted to move arcuately in response to the movement of the key to permit the hammer to move past the escapement position on the power stroke, but to engage and substantially prevent movement of the hammer after it returns to the escapement position on the recoil stroke. ("Power stroke" as used herein means that portion of the movement of the piano action in which the hammerhead moves toward and strikes the tine. "Recoil stroke" means that portion of movement wherein the hammerhead moves away from the tine after striking it, e.g., toward the rest position.)

The invention may also include braking means adapted to wedge against the hammer substantially at the rest position to prevent both the hammer and its associated key from bouncing, wobbling or vibrating noticeably, this braking means also being moved arcuately in response to the movement of the key.

The braking means which secures the hammer at substantially the escapement position ("escapement brake"), and the means which secures the hammer and key at rest position ("rest brake") are preferably cooperatively mounted to engage opposite sides of the hammer and are adapted to move through arcuate paths which intersect the arcuate path of the hammer only at the escapement position and rest position, respectively.

DETAILED DESCRIPTION OF THE INVENTION

Figure 1:
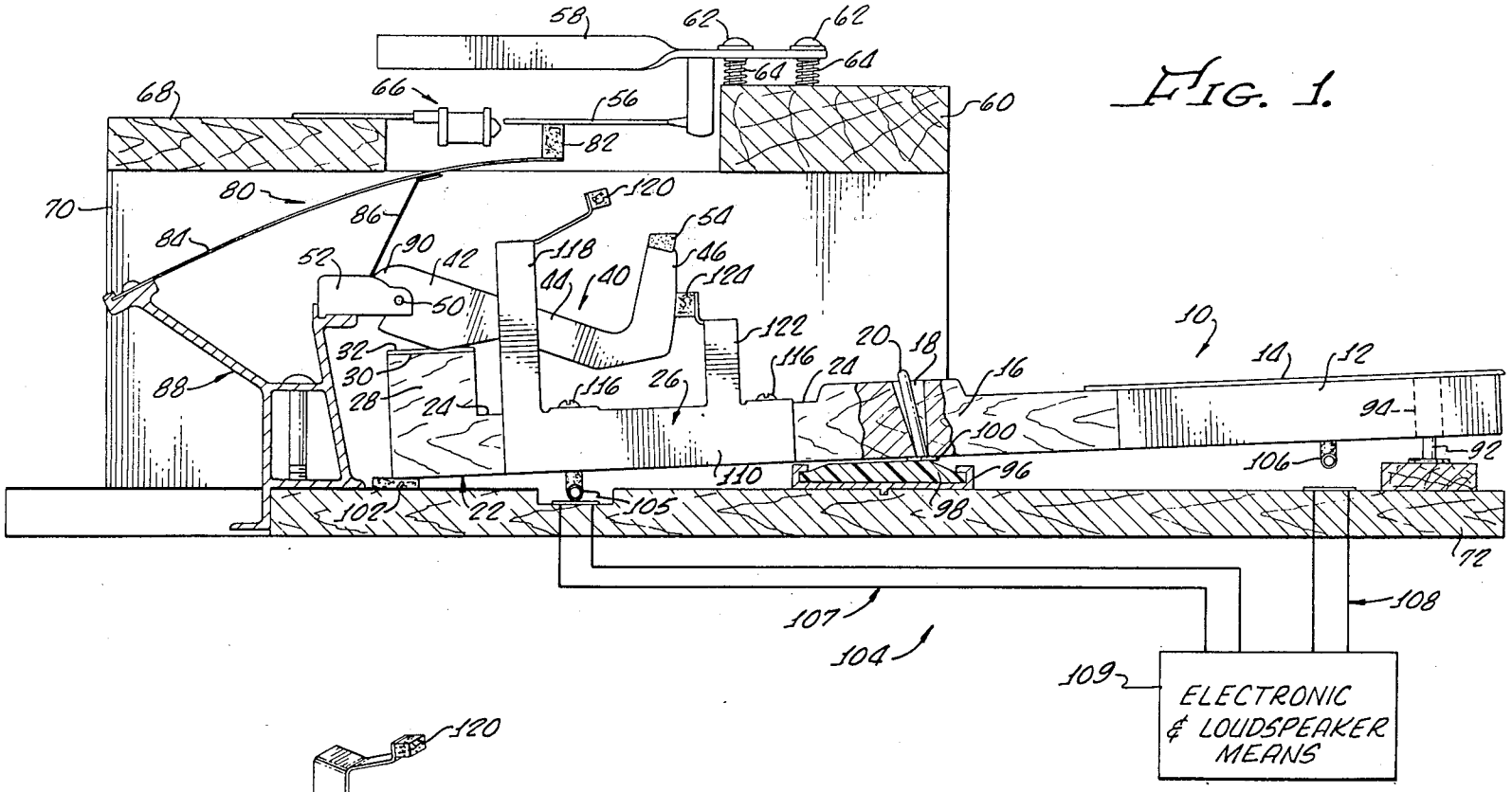
FIG. 1 is a vertical cross-sectional view illustrating the action of an electric piano, the key and hammer being at the rest position prior to the striking of the key.

FIG. 1 shows the action and supporting elements of an electric piano in cross-section. It is to be understood that in typical piano-type musical instruments, multiple (up to 88, or even more) similar arrangements will be disposed side-by-side. The sound generating components include a key 10 having a forward portion 12 with a decorative and protective simulated ivory cover 14 for striking by the pianist and a midportion 16 having an opening 18 for receiving, and pivotally mounting the key on, a pivot pin 20. The key 10 also includes a rear portion 22 composed of an elongated section 24 upon which is mounted a braking means 26 (which is described in detail hereinafter).

The rear portion 22 also includes an upwardly extending actuating and braking section 28 terminating in a planar surface 30, preferably substantially parallel to the longitudinal axis of the key. A sound deadening friction pad 32, typically composed of felt or similar substance, is adhesively fixed to planar surface 30 to provide a noise-free and cushioned contact with hammer 40.

Key 10 controls and imparts movement to the hammer 40, which includes a foot portion 42, a shank 44, and a head portion 46. The hammer 40 is rotatably mounted on axle 50 in the arms of a bifurcated support bracket 52. A hammer pad 54 is adhesively attached to the end of the hammerhead 46 and positioned so that upon rotation of the hammer upwardly the pad 54 strikes vibrating tine 56, which is attached to inertia bar 58. The inertia bar 58 is resiliently mounted on inertia bar mount 60 by means of screw fasteners 62 and springs 64.

An electromagnetic transducer or pickup means 66 senses the vibrations of vibrating tine 56 and converts them to electrical impulses which are amplified and converted to audible sound by amplifier and loudspeaker means (not shown). The transducer means 66 is mounted on transducer support member 68 which, like inertia mount 60, is affixed to vertical support means 70 extending upwardly from base member 72.

A damper assembly 80 is provided comprising a damping block 82, typically composed of felt, and a curved spring strip 84 with a flexible strap 86. The spring strip 84 is mounted on an extrusion member 88, which also supports bifurcated support bracket 52 for the rotatably mounted hammer. Extrusion member 88 is in turn supported by and mounted on base member 72.

The flexible strap 86 of the damper assembly 80 is attached at its upper extremity to curved spring strip 84 and at its other extremity to the rounded end 90 of foot portion 42 of the hammer 40. When the rear portion 28 of the key 10 is pivoted upwardly by the pianist striking the forward portion 12, it causes the hammer 40 to rotate counterclockwise about axle 50, winding the flexible strap 86 about the rounded end 90 of foot portion 42 of the hammer, thus arching spring strip 84 downwardly and pulling damping block 82 away from vibrating tine 56. Thus, when the hammer pad 54 strikes the vibrating tine, the damping block is sufficiently spaced apart from the tine to prevent its interference with the tone generation. When the pianist releases the key 10, the tension in the curved spring strip 84 causes it to spring upwardly until the damping block 82 contacts vibrating tine 56 and terminates the vibrations. At the same time, the spring strip 84 pulls flexible strap 86 upwardly, thus rotating hammer 40 clockwise about axle 50 and forcing rear portion 28 of the key 10 downward.

Also mounted on base 72 is a guide pin 92 aligned to fit in channel 94 in the forward portion 12 of key 10 to keep the key in longitudinal alignment. A pivot extrusion 96 is also secured to base member 72 and houses pin mount 98, to which pivot pin 20 is anchored. A washer 100 composed, e.g., of felt, is provided on pin 20 between the key 10 and the pin mount 98 to ensure cushioned and silent pivoting of the key.

A key stop 102, also typically composed of felt, is positioned on base member 72 beneath rear portion 28 of the key to limit the downward movement of rear portion 28 and, thus terminate counterclockwise pivoting of the key when it is in rest position, as shown in FIG. 1.

FIG. 1 also shows schematically an electronic tone generating and modulating circuit and system 104, consisting of a pair of switching means 105 and 106 adapted for opening and closing electric circuits 107 and 108 and sensing, amplifying, modulating and loudspeaker means, shown collectively at 109. Means 109 is adapted to generate and render tone-producing functions in a manner analogous to electric organs. Thus, it detects the opening and closing of circuits 107 and 108 by switches 105 and 106 (each comprising a conductive bridge between adjacent conductive pads) and produces audible sounds whose amplitudes are responsive to the velocity of the key, i.e., to the time interval between such opening and closing of the circuits.

Figure 2:
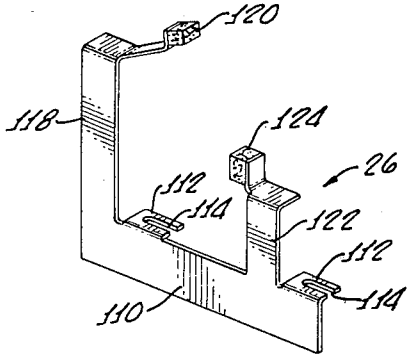
FIG. 2 is a perspective view of a unitary braking means adapted to be attached to the key for performing braking functions in accordance with the invention.

FIG. 2 shows a perspective view of braking means 26. In the embodiment shown in FIGS. 1 and 2, braking means 26 includes an angular base mounting portion 110 adapted for fastening to key 10 by means of projections 112, which have fastener slots 114 for securing to the top of the key using fasteners such as screws 116.

The braking means 26 also includes an upwardly extending escapement brake arm 118 with escapement brake pad 120, which is adapted to grip and hold the hammer 40 at escapement position when the key is fully depressed. The brake means 26 also includes an upwardly extending rest brake arm 122 with rest brake pad 124, which is adapted to engage the hammer 40 when it is in rest position, as shown in FIGS. 1 and 4.

Figure 3:
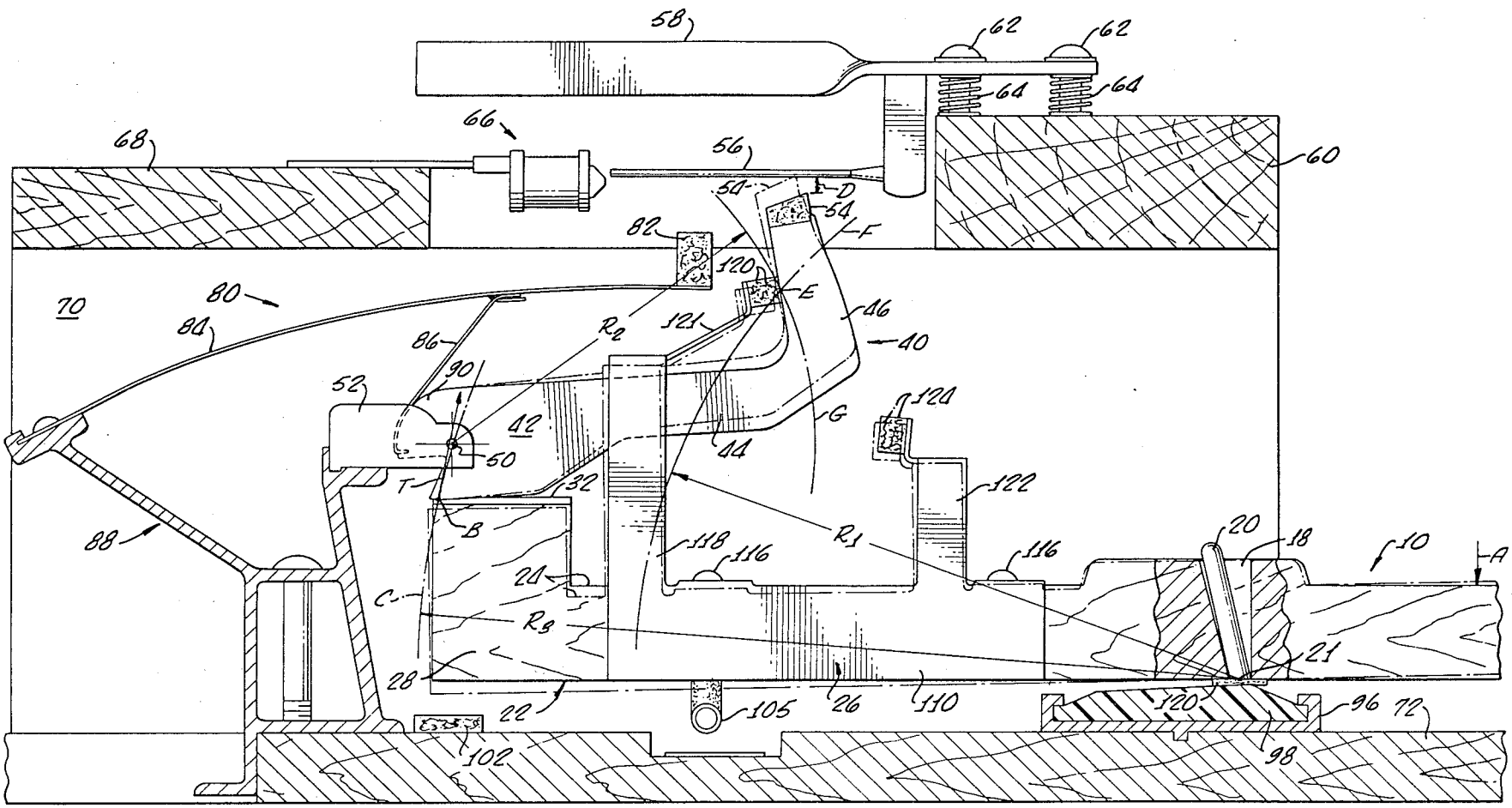
FIG. 3 is an enlarged fragmentary view illustrating the hammer and associated portion of the key with the hammer shown in sequential positions as it strikes the tine and after it is braked in the escapement position.
Figure 4:
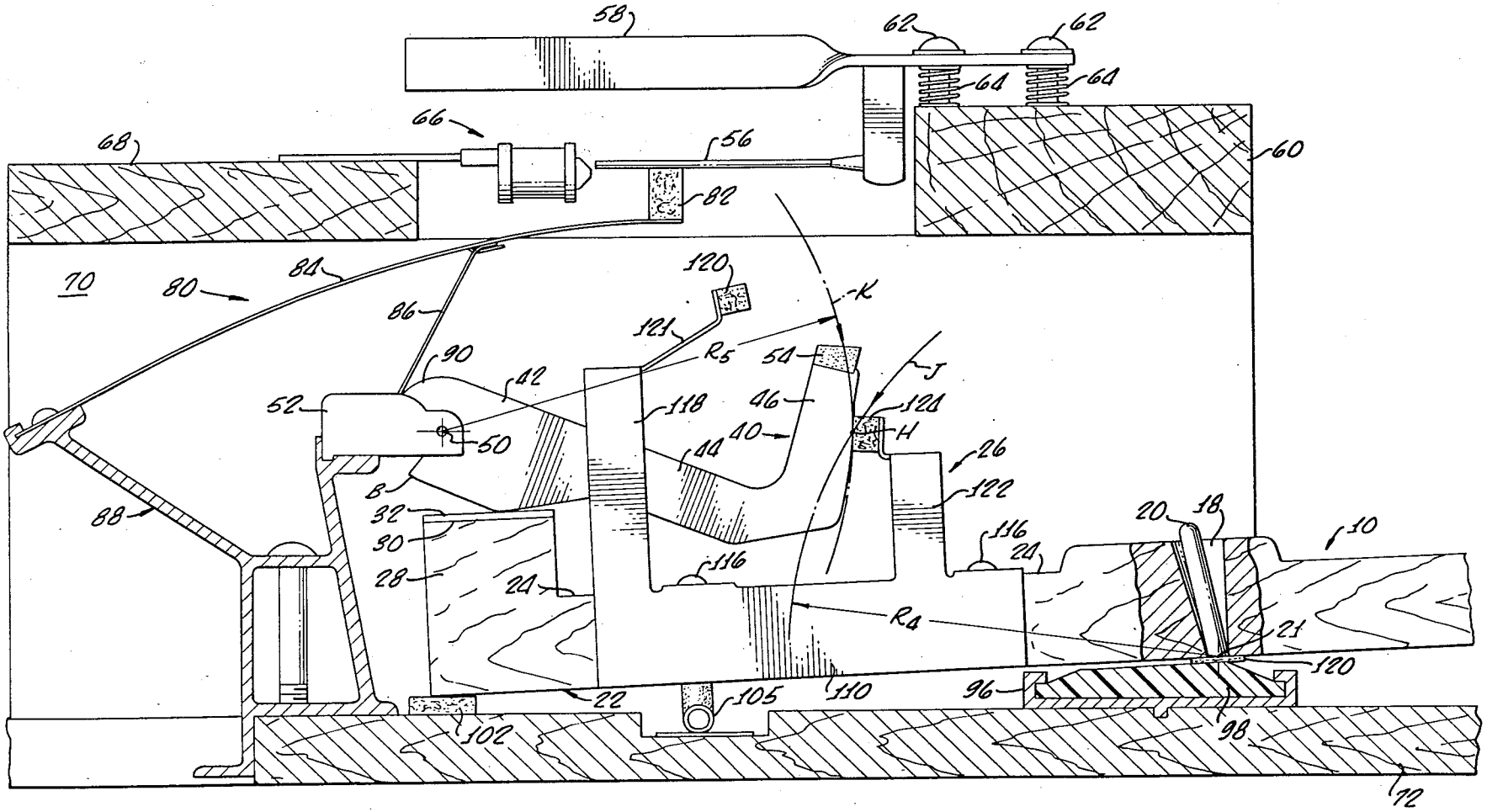
FIG. 4 is a view corresponding to FIG. 3, but illustrating the position of the key and hammer after they have returned to rest position.

The operation of the unique braking means of this invention can be better understood by reference to the enlarged fragmentary views shown in FIGS. 3 and 4. These views show an enlarged portion of the essential components shown in FIG. 1 including the key 10, the base member 72, the pivot pin 20 upon which key 10 pivots, and the hammer 40, which is mounted on extrusion member 88 along with the damper assembly 80. The tone generating elements, including the inertia bar 58 and the transducer means 66, are shown at the top of FIGS. 3 and 4.

Whereas FIG. 1 shows the key and hammer in rest position (i.e., before the key has been struck by the pianist), FIG. 3 shows the sequential positions of the key and hammer at discrete instants in time as the key is being pivoted clockwise after being struck by the pianist. The broken lines in FIG. 3 show the key, hammer, and braking means 26 at the instant the hammer pad 54 is striking the vibrating tine 56. The solid lines show the key, hammer, and braking means an instant later, after the hammer has recoiled or fallen to the escapement position. It will be observed that when the hammer 40 is in escapement position, it is in contact with escapement brake pad 120, the center of contact area being at point E. It will also be noted that the center of the contact area of the escapement brake pad 120 moves along arc F at a radius $R_1$ from pivot point 21 at the axis of pivot pin 20, the pad 120 moving as a unit with key 10 to which the braking means 26 is attached.

It will also be observed that the corresponding center of the contact area of the hammerhead moves along an arc G at a radius $R_2$ from axle 50 as the hammer 40 rotates towards and away from vibrating tine 56, and coincides with the center of contact of the escapement brake pad at point E.

It is of particular significance that the arcs F and G intersect only at point E, when the hammer is at escapement position with the hammer pad 54 located at the escapement distance D below the vibrating tine 56.

In operation, as the pianist exerts pressure forcing the key 10 downwardly at its outer portion, as indicated in FIG. 3 by the arrow A, the rear portion 28 moves upwardly to the position shown in broken lines, forcing and impelling the hammer 40 upwardly so that it rotates counterclockwise about axle 50 until the pad 54 strikes tine 56. It is to be noted that when the hammer is at this most extreme counterclockwise position with the pad striking the tine, the key 10 has not yet been completely pivoted to its most extreme clockwise position, and, accordingly, the escapement brake pad 120 is in the position shown in broken lines and is out of contact with and spaced apart from the head 46 of the hammer 40. Thus, as the hammer is moving upwardly, it is in essentially free-flight, unrestricted by any substantial contact with the escapement brake pad 120, and control, if any, over the flight of the hammer is maintained only by the slight, gentle frictional forces and cushioning forces exerted by the somewhat resilient, compressible pad 32, which may contact the foot portion 42 of the hammer.

In the instant after hammer pad 54 strikes tine 56, the hammer recoils or falls clockwise away from tine 56 toward the escapement position. During this time the pressure by the pianist on the key causes the rear portion 28 of the key to continue moving upwardly, to the position depicted by the solid lines, until the bottom of the foot 42 of the hammer rests flatly against key pad 32 and thus prevents the hammer from rotating any further in a clockwise direction. In the absence of a braking means, there would be a tendency for the hammer after recoiling to rebound upwardly again, and this would possibly result in double-striking of the tine 56 (and a corresponding movement of the key). However, as the hammer commences to rebound, it is engaged smoothly and firmly by escapement brake pad 120 centered about point E.

As can be seen from the positions of the overlapping arcs F and G, the movement of either the hammer 40 in a counterclockwise direction or the key 10 in a clockwise direction simply wedges pad 120 more tightly against the head 46 of the hammer, thus braking its motion completely and preventing any double-striking of the tine. Thus, the escapement brake means is self-adjusting in that the harder the pianist strikes the key, the more likely the velocity of the recoil would be to cause an undesirable secondary stroke on rebound; however, the harder the key is struck, the more force is applied to the escapement brake pad, and this compensates for the increased tendency of the hammer to rebound. Conversely, when the pianist plays the keys softly, there is only a slight tendency for the hammer to rebound, and, accordingly, only a slight force on the brake pad 120 is needed to prevent such rebounding and double-striking.

It will be appreciated that a critical aspect of the invention is that the escapement brake pad 120 in no way impedes the counterclockwise motion of the hammer when it is on the power stroke, since the hammerhead is impelled upwardly at high velocity past the escapement position before the key has pivoted to its extreme clockwise position and, thus, before pad 120 has moved along arc F to point E.

It should be noted that when the hammer is positioned at the escapement position after recoiling from impacting the tine 56, there will preferably be at least one point of contact B between the foot of the hammer and the pad 32 on the rear portion 28 of the key, which point is positioned to restrain movement of the hammer in either direction from the escapement position. Thus, a tangent T passing through point B on arc C at a radius $R_3$ from the pivot axis 21 of the key will pass upwardly, as shown on FIG. 3, such that axle 50 is positioned substantially on the tangent T or between the tangent and arc C. By so designing the area of contact between the key and the hammer, this restraining function will cooperate with the braking function of pad 120 at the contact area around point E to completely eliminate rebounding and eliminate any detectable undesired motion or vibration of the hammer after it recoils from striking the tine.

In the particularly preferred embodiment of the invention shown in FIG. 3, the pad 120 is secured to arm 121, which is extended in a direction substantially perpendicular to arc G at point E, such that increased pressure on the key creates an increased force vector on pad 120 directly against the hammerhead 46.

FIG. 4 depicts the position of the various components after the pianist has released the key and it has returned to its rest position. It will be noted that in this position rest brake pad 124 engages the forward side of the hammerhead 46 at a contact area centered about point H. The point on the pad corresponding to point H lies on an arc J which is positioned at a radius $R_4$ from the pivot axis 21 of the key. The point on the forward side of the hammer corresponding to point H lies on an opposing arc K which is positioned at a radius $R_5$ from hammer axle 50. In a manner similar to that described above for the escapement brake operation, the relative movement of the hammer and the key as they approach the rest position is such as to wedge pad 124 against the hammer and, thus, prevent its continued rotation, rebounding, vibration, or other undesired movement.

By the use of the combination of the escapement brake means and the rest brake means, it is possible for the first time to produce a musical instrument of the piano type having very small escapement distances of $\frac{1}{8}''$, or even less, and capable of high quality performance under the most demanding conditions. For example, when the pianist repeatedly strikes the same key as rapidly as possible with soft strokes, hard strokes, or any combination of strokes, the hammer will move smoothly through both the power stroke and the recoil stroke without any noticeable undesired movements.

It is to be noted that the areas or surfaces of contact of the hammer with both the escapement brake pad (FIG. 3) and with the rest brake pad (FIG. 4) are on portions of the hammer remote from the hammer foot. Preferably, for optimum control, these contact surfaces are on or near the head of the hammer and run transverse to the axis of the shank (and to the surface of contact between the foot 42 of the hammer and the pad 32 on the key). In the particularly preferred embodiment shown, the escapement brake pad and rest brake pad engage the hammer on opposite sides of the head portion at positions substantially above the axis of the shank, to give excellent key and hammer control.

Also, the cooperative combination of the escapement brake means and the rest brake means, by virtually eliminating undesired bounces, vibrations, wobbles and other movements of the key and hammer at both the rest position and the escapement position, makes it possible for the first time to employ the key directly as a switch-actuating means in pianos, thus achieving a high quality organ-type electronic tone generating and modulating circuit and system 104 (shown in FIG. 1). Such systems are highly sensitive to any undesired movements of switches 105 and 106, since such movements may effect the generation of undesired repeated tones as well as noise. However, with the unique duality of functions of the braking means of this invention, it is now possible to eliminate all such undesired sounds.

The invention described herein can be advantageously used with a wide variety of piano-type actions. For example, it can be used in combination with actions of the type described in my U.S. Pat. No. 3,270,608 (the disclosure of which is hereby incorporated by reference as though set forth in full) to give a combined braking effect superior to that of any actions heretofore known.

Many other uses and variations of the invention will be apparent to those skilled in the art, and while specific embodiments of this invention have been described, these are intended for illustrative purposes only. It is intended that the scope of the invention be limited only by the attached claims.

I claim:

1. In an action for a musical instrument of the piano type wherein a tone is generated by striking a key to impel a hammer which strikes a tine on a power stroke, then recoils therefrom, and thereafter returns to its original rest position when the key is released, said action including a key having a forward portion, a rear portion, and a mid portion therebetween, means for pivoting said key about a transverse axis in the mid portion thereof, a hammer having a head portion for striking the tine, a foot portion for engaging the rear portion of said key, and a shank connecting the head portion and the foot portion, and means for rotating said hammer about a transverse axis through the foot portion thereof, the improvement comprising:

an escapement brake means for restraining said hammer to prevent it from rebounding and striking said tine more than once for each strike of the key, said escapement brake means being affixed to the rear portion of said key for pivoting therewith and including:

engaging means responsive to the pivoting of said key for engaging a portion of the hammer remote from the foot thereof on said hammer's recoil after striking said tine, and said means for rotating said hammer being adapted to cause said hammer to strike said tine on the power stroke before said engaging means contacts said hammer.

2. The improvement recited in claim 1 wherein the foot portion of said hammer is so contoured that when said forward portion of the key is fully depressed after a power stroke, the rear portion engages said foot portion of the hammer and prevents the head portion from recoiling away from the vibrating tine beyond a predetermined escapement position and wherein said engaging means of said escapement brake is positioned to substantially engage said head portion at said escapement position and restrain the hammer from rebounding towards the tine.

3. The improvement recited in claim 2 wherein said engaging means comprises an escapement brake pad for frictionally contacting said head portion over a contact area substantially centered about an escapement brake contact point, said contact point lying on a pivot arc of predetermined radial distance from said pivot axis of the key and also lying on a rotation arc of predetermined radial distance from said transverse axis through the foot portion of said hammer, said contact point being the sole point of intersect of said pivot arc and said rotation arc during the movements of said hammer and key through the power stroke and the return to rest position of the hammer and key, whereby said escapement brake means restrains said hammer only when said hammer is substantially in escapement position.

4. The improvement recited in claim 3 wherein said escapement brake means includes an elongated support member, said member being affixed at one extremity to said brake pad and affixed at its other extremity to the rear portion of said key intermediate the pivot axis thereof and the portion engaged with the foot portion of said hammer.

5. The improvement recited in claim 4 wherein at least a portion of said elongated support member adjacent said one extremity is positioned substantially perpendicular to said rotation arc when the hammer is restrained at the escapement position.

6. The improvement as recited in claim 1 further comprising:

rest brake means for mutually restraining said hammer and said key to prevent undesired movements thereof, said rest brake means including:

rest brake engaging means for engaging the head portion of the hammer when both said key and said hammer are substantially in rest position, and means responsive to the pivoting of said key for disengaging said rest brake engaging means upon the striking of the key by a pianist.

7. The improvement recited in claim 6 wherein said rest brake engaging means comprises a rest brake pad for frictionally contacting said head portion over a contact area substantially centered about a rest brake contact point, said contact point lying on a pivot arc of predetermined radial distance from said pivot axis of the key and also lying on a rotation arc of predetermined radial distance from said transverse axis through the foot portion of said hammer, said rest brake contact point being the sole point of intersect of said pivot arc and said rotation arc during the movement of said hammer and key through the power stroke and the return to rest position of the hammer and key, whereby said rest brake means restrains said hammer and key only when said hammer and key are in substantially rest positions.

8. The improvement as recited in claim 7 wherein said rest brake means includes an elongated support member, said member being affixed at one extremity to said rest brake pad and affixed at its other extremity to the rear portion of said key intermediate the pivot axis thereof and the portion engaged with the foot portion of said hammer.

9. In an action for a musical instrument of the piano type wherein a tone is generated by striking a key to impel a hammer which strikes a tine on a power stroke and then recoils therefrom and thereafter returns to its original rest position when the key is released, said action including a key having a forward portion, a rear portion and a mid portion therebetween, means for pivoting said key about a transverse axis in the mid portion thereof, a hammer having a head portion for striking the tine, a foot portion for engaging the rear portion of said key, and a shank connecting the head portion to the foot portion, and means for rotating said hammer about a transverse axis through the foot portion thereof, the improvement comprising:

an escapement brake means affixed to the rear portion of the key for restraining said hammer to prevent it from rebounding and striking said tine more than once for each striking of the key, said escapement brake means including:

engaging means responsive to the pivoting of said key for engaging the hammer on its recoil after striking said tine, said engaging means comprising an escapement brake pad for frictionally contacting said head portion over a contact area substantially centered about an escapement brake contact point, said contact point lying on a pivot arc of predetermined radial distance from said pivot axis of the key and also lying on a rotation arc of predetermined radius from said transverse axis through the foot portion of said hammer, said contact point being the sole point of intersect of said pivot arc and said rotation arc during movement of said hammer through the power stroke and the return to rest position of the hammer and key, and said means for rotating said hammer being adapted to cause said hammer to strike said tine on the power stroke before said engaging means contacts said hammer; and rest brake means for mutually restraining said hammer and said key to prevent undesired movements thereof, said rest brake means including:

rest brake engaging means for engaging the hammer when both said key and said hammer are substantially in rest position, said rest brake engaging means comprising a rest brake pad for frictionally contacting said head portion over a contact area substantially centered about a rest brake contact point, said contact point lying on a pivot arc of predetermined radial distance from said pivot axis of the key and also lying on a rotation arc of predetermined radial distance from said transverse axis through the foot portion of said hammer, said contact point being the sole point of intersect of said pivot arc and said rotation arc during the movement of said hammer and key through the power stroke and the return to rest position of the hammer and key, and means responsive to the pivoting of said key for disengaging said rest brake engaging means upon the striking of the key by a pianist, whereby said escapement brake means and rest brake means restrain said hammer only when said hammer is substantially in escapement position and rest position.

10. In an action for a musical instrument of the piano type wherein a tone is generated by striking and pivoting a key about a pivot axis to impel a hammer which strikes a tine on a power stroke, then recoils therefrom, and thereafter returns to its original rest position when the key is released, said hammer having a head portion for striking the tine, a foot portion for engaging the key, and a shank connecting the head portion to the foot portion, the improvement comprising:

means for rotating said hammer about a transverse axis through the foot portion thereof, engaging means affixed to the rear portion of the key responsive to the pivoting of said key for engaging the hammer on its recoil after striking the tine, said engaging means comprising an escapement brake pad for frictionally contacting said head portion over a contact area substantially centered about an escapement brake contact point, said contact point lying on a pivot arc of predetermined radial distance from said pivot axis of the key and also lying on a rotation arc of predetermined radial distance from said transverse axis through the foot of said hammer, said contact point being the sole point of intersect of said pivot arc and said rotation arc during movement of said hammer through the power stroke and the return to rest position of the hammer and key, rest brake engaging means for engaging the hammer when both the key and said hammer are substantially in rest position, said rest brake engaging means comprising a rest brake pad for frictionally contacting said head portion over a contact area substantially centered about a rest brake contact point, said contact point lying on a pivot arc of predetermined radial distance from said pivot axis of the key and also lying on a rotation arc of predetermined radial distance from said transverse axis through the foot portion of said hammer, said contact point being the sole point of intersect of said pivot arc and said rotation arc during the movement of said hammer and key through the power stroke and the return to rest position of the hammer and key, and means responsive to the pivoting of said key for disengaging said rest brake engaging means upon the striking of the key by a pianist, whereby said escapement brake means and rest brake means restrain said hammer only when said hammer is substantially in escapement position and rest position.

* * * * *